United States Patent [19]

Bunge

[11] 4,341,316

[45] Jul. 27, 1982

[54] INSULATING VESSEL

[76] Inventor: John M. Bunge, 5 Melton Ct., Old Brompton Rd., London S.W. 7, England

[21] Appl. No.: 144,657

[22] Filed: Apr. 28, 1980

[30] Foreign Application Priority Data

May 29, 1979 [GB] United Kingdom ..... 7918567

[51] Int. Cl.[3] ..... B65D 6/10

[52] U.S. Cl. ..... 215/13 R

[58] Field of Search ..... 215/13 R, 13 A; 220/447, 446; 150/52 R

[56] References Cited

U.S. PATENT DOCUMENTS

| | | | |
|---|---|---|---|
| 2,895,636 | 7/1959 | Martin | 215/13 R X |
| 2,995,267 | 8/1961 | Ostrander | 215/13 R X |
| 3,120,570 | 2/1964 | Kennedy | 215/13 R X |
| 3,355,045 | 11/1967 | Douglas | 215/13 R |
| 3,355,046 | 11/1967 | Jolly | 215/13 R |
| 3,977,552 | 8/1976 | Lombardo | 215/13 R |

FOREIGN PATENT DOCUMENTS

| | | | |
|---|---|---|---|
| 1149650 | 7/1957 | France | 215/13 R |
| 561528 | 5/1975 | Switzerland | 215/13 R |
| 211216 | 2/1924 | United Kingdom . | |
| 455232 | 10/1936 | United Kingdom . | |
| 1020235 | 2/1966 | United Kingdom . | |
| 1251595 | 10/1971 | United Kingdom . | |
| 1281534 | 7/1972 | United Kingdom . | |
| 1495386 | 12/1977 | United Kingdom . | |

*Primary Examiner*—Donald F. Norton

*Attorney, Agent, or Firm*—Schwartz & Weinrieb

[57] ABSTRACT

An insulating vessel to contain snugly a wine bottle comprises a container member located substantially within an outer jacket to define a space therebetween. The space may be either filled with air or partially evacuated or filled with an insulating material.

7 Claims, 3 Drawing Figures

INSULATING VESSEL

FIELD OF THE INVENTION

This invention relates generally to insulating vessels and more particularly to an insulating vessel for a bottle such as, for example, a wine bottle.

BACKGROUND OF THE INVENTION

Many types of wine should be served and retained at a temperature below normal room temperature if the wine is to be fully appreciated. Whilst bottles of such wine are often chilled prior to opening, the bottles are then, for example during the course of a meal, placed on a table and in a relatively short time the temperature of the wine will increase to a temperature close to the ambient temperature of the room. Thus, whilst the wine may initially be at the optimum temperature, wine subsequently poured from the bottle could be much warmer and could consequently not be fully appreciated. It is possible to place the bottle of wine in a bucket full of ice, but this has the disadvantage that the bottle then becomes wet on the outside.

OBJECTS OF THE INVENTION

This invention seeks to provide an insulating vessel for retarding the exchange of heat between the atmosphere surrounding the vessel and an item, such as a bottle, stored in the vessel.

BRIEF DESCRIPTION OF THE PRESENT INVENTION

According to one aspect of this invention there is provided an insulating vessel comprising: a container member and an outer jacket; the container member having a bottom wall and a side wall defining a cavity therein which is dimensioned snugly to receive a wine bottle, the side wall being continuous and upstanding, the outer jacket comprising a bottom wall and a side wall, the side wall being continuous and upstanding; the container member being located substantially within the outer jacket to define a space therebetween.

Conveniently, said upstanding side wall of said outer jacket is provided at the top thereof with a flange which extends inwardly, and said upstanding side wall of said container member is provided at the top thereof with a flange which extends outwardly, said two flanges engaging one another to seal said space from the atmosphere.

Preferably, said bottom wall of said container member is provided with a projection adapted to engage said bottom wall of said outer jacket to support said bottom wall of said container member.

Suitably, said bottom wall of said outer jacket is provided with a wall which is upstanding and which is adapted to engage said projection of said bottom wall of said container member.

According to another aspect of the invention, there is provided an insulating vessel comprising: a container member having a bottom circular wall and an upstanding side wall, said side wall being continuous, said container member defining a cavity dimensioned snugly to receive a wine bottle; and an outer jacket comprising a bottom portion and a cylindrical sleeve portion having an upper extremity, said bottom portion comprising a circular bottom wall and a side wall, said side wall of said bottom portion being continuous and upstanding; said cylindrical sleeve portion engaging, and being supported by, said upstanding side wall of said bottom portion, said container member being substantially located within said outer jacket such that said container portion engages said sleeve portion, and such that a space is defined between the container member and the outer jacket.

Preferably, said upper extremity of the sleeve portion is provided with a peripheral flange which extends inwardly and said container member is provided with an upper extremity which has an outwardly extending flange, said inwardly extending flange being adapted to engage said outwardly extending flange, said flanges cooperating with one another to position said container member and said outer jacket in a predetermined relative position.

Suitably, said flanges cooperate with one another to seal said space defined between said container member and said outer jacket from the atmosphere.

Alternatively, said bottom wall of said container member is provided with a projection, said projection engaging said bottom wall of said outer jacket.

Preferably, said bottom wall of said outer jacket is provided with an upstanding wall which defines an upwardly open recess, the projection on the bottom wall of the container member being located within said recess.

Conveniently, said space defined between said container member and said outer jacket contains air, or is partially evacuated, or is filled with a thermal insulating material.

BRIEF DESCRIPTION OF THE DRAWINGS

The invention may be more readily understood and further features thereof may be better appreciated if reference is made to the accompanying drawings in which.

DETAILED DESCRIPTION OF THE PREFERRED EMBODIMENT

Figure 1:
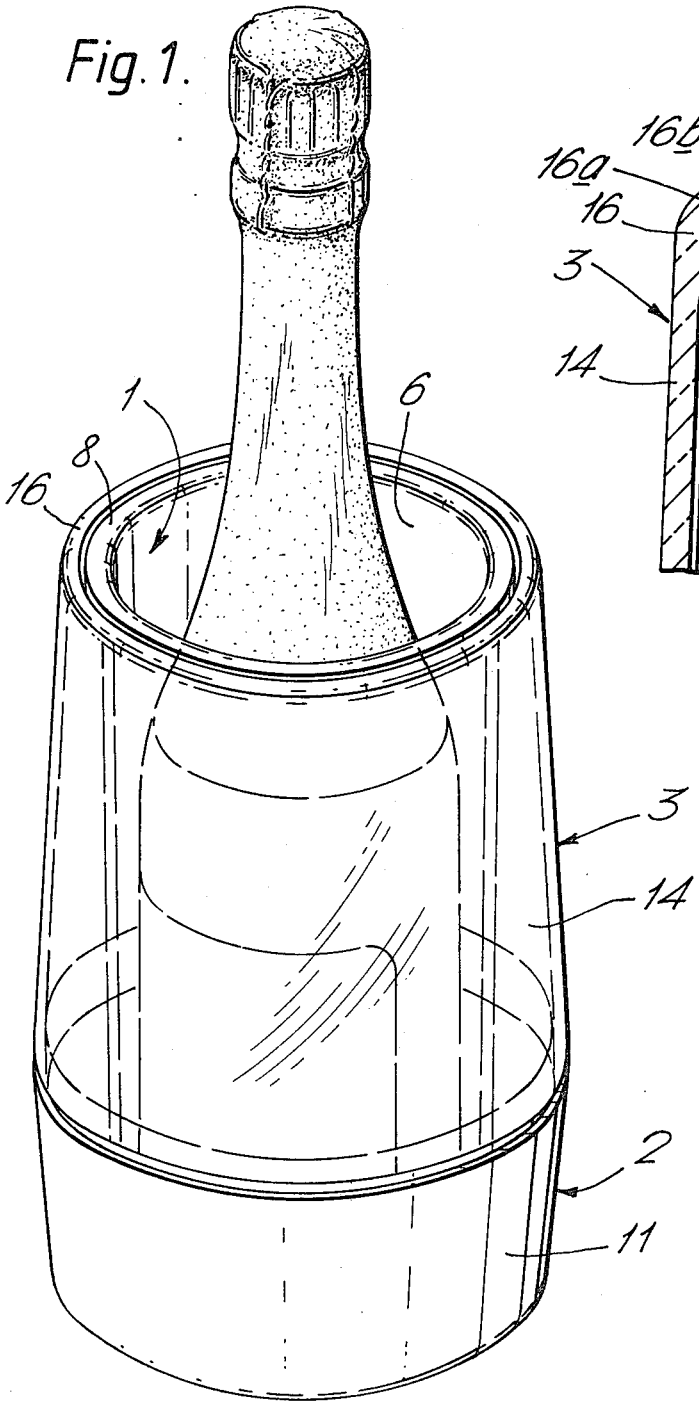
FIG. 1 is a perspective view of an insulating vessel in accordance with the invention, containing a wine bottle.

Referring to FIG. 1, the insulating vessel comprises a container member 1 and an outer jacket comprising a bottom portion 2 and a sleeve portion 3.

Figure 2:
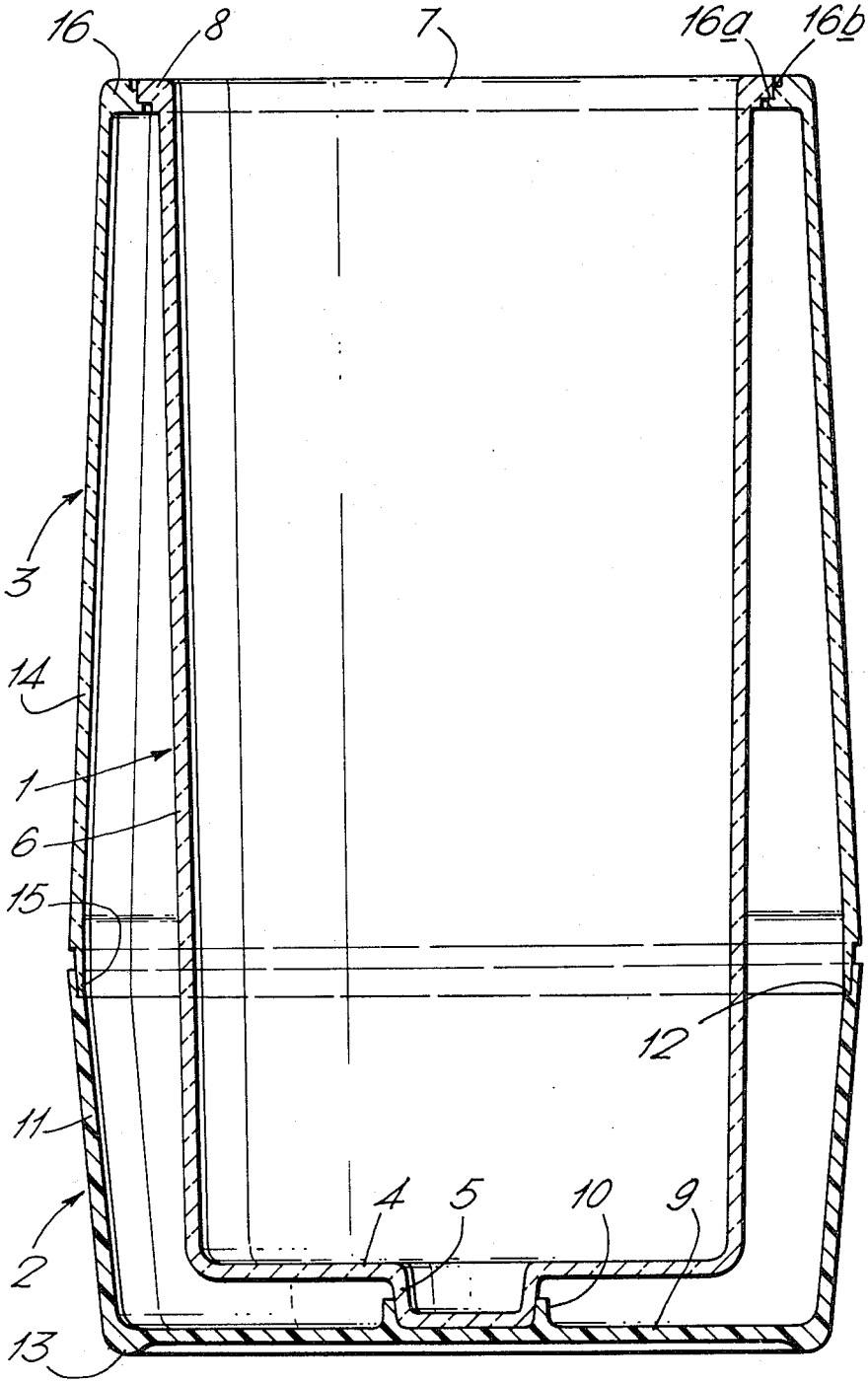
FIG. 2 is a vertical section of the vessel of FIG. 1, with the wine bottle omitted.

Referring to FIG. 2, the container member 1 comprises a circular bottom wall 4 having a central circular downwardly extending projection 5 formed therein. An integral continuous side wall 6 extends upwardly and is flared slightly outwardly from the periphery of the base wall 4 and defines at its upper extremity a circular aperture 7. The upper extremity of the side wall 6 is provided with a peripheral outwardly protruding flange 8 of inverted "L"-shaped cross section.

The bottom portion 2 of the outer jacket comprises a circular bottom wall 9 of greater diameter than the bottom wall 4 of the container member. The bottom wall 9 of the outer jacket is provided with a central ringlike retaining wall 10 of an internal diameter slightly greater than the external diameter of the circular projection 5 of the container member. An upwardly and slightly outwardly extending integral side wall 11 extends from the periphery of the bottom wall 9 for a short distance and is provided at its upper extremity with a generally circular inwardly stepped inner edge portion 12. A peripheral downwardly extending bead 13 is provided beneath the base wall 9 of the bottom portion 2.

The sleeve portion 3 of the outer jacket comprises a side wall 14 of generally tubular configuration which extends upwardly and is flared slightly inwardly from a lower generally circular inwardly stepped outer edge portion 15, which is adapted to co-operate with the inner edge portion 12 of the bottom portion 2 to enable the connection of the sleeve portion 3 to the bottom portion 2. The side wall 14 of the sleeve portion 3 terminates at an inwardly extending generally circular flange 16 which defines two steps **16*a*, 16*b***.

The insulating vessel is assembled by lowering the sleeve portion 3 onto the bottom portion 2 so that the outer edge portion 15 of the sleeve portion 3 engages with the inner edge 12 of the bottom portion 2. The edge portions 15, 12 cooperate to hold the elements of the outer jacket in position relative to one another and if a permanent connection is desired adhesive may be used or the edge portions 15, 12 may be sealingly welded to one another in an appropriate manner.

Figure 3:
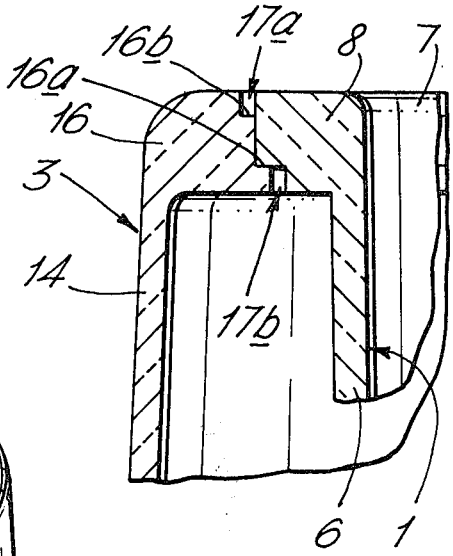
FIG. 3 is an enlarged section of a joint between the sleeve portion of the vessel and the container portion.

The assembly of the vessel is completed by lowering the container member 1 into the outer jacket until the projection 5 is positioned within the ring-like retaining wall 10 and touches the bottom wall 9 of the bottom portion 2 of the outer jacket. As shown in FIG. 3, when the container member is in this position the flange 8 engages the flange 16 of the outer jacket, the outermost part of the flange 8 being located against the step **16*a* in such a way that a first annular groove 17*a* is defined between the step 16*b* of the flange 16 and the flange 8 and a second annular groove 17*b* is defined between the lowermost part of the flange 16 and the lowermost part of the flange 8. Adhesives may be used to secure the flanges together and if desired additional adhesive may be used at the interface between the recessed portion 5 and the bottom wall 9** of the outer jacket. Again, alternatively, the container member and the outer jacket may be secured by welding or any other suitable means.

The component parts of the insulating vessel are moulded from plastic material, the container member 1 and the sleeve portion 3 being formed of a clear plastic material and the bottom portion 2 being formed of an opaque or coloured plastics material. The material of the insulating vessel is itself a heat insulating material and in addition the assembled components of the vessel define a closed space which serves further to insulate the interior of the container member from the exterior of the vessel. The closed space may contain air or may be partially evacuated if desired. Alternatively the space may contain a thermal insulating material such as, for example, a foamed plastic material.

In FIG. 1, the vessel is shown in use. A bottle of wine which has been cooled below room temperature is placed within the container member of the insulating vessel and the insulating vessel is then for example, placed on a table so that wine may be poured from the bottle as and when desired. The insulating vessel serves to insulate the bottle and its contents from the atmosphere and thus to maintain the wine in a chilled condition.

To facilitate the insulating of a bottle of wine, the insulating vessel is dimensioned in accordance with standard wine bottle sizes. It will be appreciated that there are a number of standard wine bottle sizes and consequently insulating vessels of various corresponding sizes may be manufactured. It has, however, been found that a significant spacing between the inner wall of the container member and a bottle stored in the vessel can be tolerated without significantly reducing the insulating effectiveness of the vessel and thus it would be possible to provide a single insulating vessel for use with a variety of standard wine bottle sizes.

The rate of increase of temperature of wine in a bottle when contained in the preferred embodiment of an insulating vessel in accordance with the invention has been measured. This measured value has been compared with the rate of increase of temperature of wine in an uninsulated bottle. It has been discovered that over a significant period of time the insulating vessel maintained the wine at a reasonable temperature whereas the uninsulated wine relatively quickly warmed to a temperature close to room temperature.

The results of one such test are given below. In this test two bottles of initially chilled Hock wine were tested, the temperature of the wine in each bottle being taken at 15 minute intervals, the ambient temperature of the surroundings being a constant 21° C. and one glass of wine being poured from each bottle following each temperature reading.

| minutes | temperature in insulated bottle | temperature of wine in uninsulated bottle |
|---|---|---|
| 0 | 4.5° C. | 4.5° C. |
| 15 | 5° C. | 7° C. |
| 30 | 5.25° C. | 10° C. |
| 45 | 5.5° C. | 12° C. |
| 60 | 6.5° C. | 14° C. |
| 75 | 10° C. | 18° C. |

As will be apparent from the above results, after an hour and a quarter the remaining wine in the uninsulated bottle has reached a temperature close to room temperature whilst the remaining wine in the insulated bottle is still relatively cool.

Whilst the wine cooler described above by way of example comprises a container member and sleeve portion formed of a clear plastic material and a bottom portion formed of an opaque or coloured plastics material, it will be appreciated that in an alternative embodiment one or more of the component parts may be formed of clear, semi-clear or opaque plastic material which may be tinted or coloured as desired. In one possible embodiment the three component parts of the insulating vessel may each be formed of clear plastic material and in another alternative embodiment the three components may each be formed of opaque plastic material of a particular colour.

Obviously, many modifications and variations of the present invention are possible in light of the above teachings. It is therefore to be understood that within the scope of the appended claims, the present invention may be practiced otherwise than as specifically described herein.

I claim:

1. An insulating vessel for a wine bottle, comprising:
an outer jacket comprising a bottom wall and a continuous upstanding cylindrical side wall means; and
a container member disposed internally of said outer jacket and spaced therefrom so as to define a space therebetween, said container member comprising a bottom wall and a continuous upstanding cylindrical side wall means defining a cavity therewithin so as to snugly receive therein a wine bottle, the upper portion of said side wall means of said outer jacket at an elevation above said bottom wall of said container being transparent while the portion of said side wall means of said outer jacket below said elevation being opaque, and said container member side wall means also being transparent, so as to enable substantially the entire height extent of said wine bottle disposed within said container cavity to be seen within said container cavity from a reference point outside said insulating vessel.

2. The insulating vessel as set forth in claim 1, wherein:

said side wall means of said outer jacket is provided with flange means extending radially inwardly at the top thereof;

and said side wall means of said container member is provided with flange means extending radially outwardly at the top thereof, said two flange means engaging one another so as to seal said space from the atmosphere.

3. An insulating vessel for a wine bottle, comprising:

an outer jacket comprising a bottom wall having an upstanding, annular boss, and a continuous upstanding cylindrical side wall means the top of which is provided with radially inwardly extending annular flange means; and a container member disposed internally of said outer jacket and spaced therefrom so as to define a space therebetween, said container member comprising a bottom wall having a depending projection for engaging said boss of said outer jacket, and a continuous upstanding cylindrical side wall means defining a cavity therewithin so as to snugly receive therein a wine bottle, the upper end of said side wall means being provided with a radially outwardly extending annular flange means for engaging said flange means of said outer jacket so as to seal said space from the atmosphere, the upper portion of said side wall means of said outer jacket at an elevation above said bottom wall of said container being transparent while the portion of said side wall means of said outer jacket below said elevation being opaque, and said container member side wall means also being transparent, so as to enable substantially the entire height extent of said wine bottle disposed within said container cavity to be seen within said container cavity from a reference point outside said insulating vessel.

4. An insulating vessel for a wine bottle, comprising:

an outer jacket comprising a bottom member including a circular bottom wall and an upstanding cylindrical side wall means, said bottom wall having an upstanding annular boss means provided thereon, said outer jacket further comprising a cylindrical sleeve portion disposed atop said upstanding side wall means of said outer jacket bottom member and provided at the upper end thereof with radially inwardly projecting flange means; and a container member disposed internally of said outer jacket and comprising a bottom wall having a depending projection for engaging said outer jacket bottom wall annular boss means, and a continuous upstanding cylindrical side wall means defining a cavity therewithin so as to snugly receive therein a wine bottle, the upper end of said container side wall means being provided with a radially outwardly projecting annular flange for engaging said flange means of said outer jacket sleeve portion whereby said projection and boss means, and said engaging flange means, of said container and jacket serve to support said container member within said outer jacket in a spaced relationship, said upstanding cylindrical side wall means of said outer jacket bottom member being opaque while said outer jacket sleeve portion and said container member are fabricated of transparent material so as to enable substantially the entire height extent of said wine bottle disposed within said container cavity to be seen within said container cavity from a reference point outside said insulating vessel.

5. The insulating vessel as set forth in claim 4, wherein:

said space defined between said container member and said outer jacket contains air.

6. The insulating vessel as set forth in claim 4, wherein:

said space defined between said container member and said outer jacket is partially evacuated.

7. The insulating vessel as set forth in claim 4, wherein:

said space defined between said container member and said outer jacket is filled with a thermal insulating material.

* * * * *